United States Patent [19]

Yoerger et al.

[11] Patent Number: 5,061,593

[45] Date of Patent: Oct. 29, 1991

[54] COATED CARRIER PARTICLES FOR ELECTROGRAPHIC DEVELOPERS

[75] Inventors: William E. Yoerger; Frank A. Pettrone, both of Rochester, N.Y.

[73] Assignee: Eastman Kodak Company, Rochester, N.Y.

[21] Appl. No.: 449,685

[22] Filed: Dec. 12, 1989

[51] Int. Cl.[5] ..... G03G 9/00; G03G 5/00

[52] U.S. Cl. ..... 430/108; 430/137; 430/904

[58] Field of Search ..... 430/108, 137, 904

[56] References Cited

U.S. PATENT DOCUMENTS

| | | | |
|---|---|---|---|
| 3,922,382 | 11/1975 | Kukla et al. | 430/108 |
| 4,209,550 | 6/1980 | Hagenbach et al. . | |
| 4,572,885 | 2/1986 | Sato et al. . | |
| 4,601,968 | 7/1986 | Hyusu | 430/137 |
| 4,652,511 | 3/1987 | Ueda et al. | 430/137 |
| 4,791,041 | 12/1988 | Aoki et al. | 430/108 |
| 4,822,708 | 4/1989 | Machida et al. | 430/108 |
| 4,845,006 | 7/1989 | Matsubara et al. | 430/99 |
| 4,855,206 | 8/1989 | Saha | 430/108 A |

FOREIGN PATENT DOCUMENTS 1385231 2/1975 United Kingdom .

*Primary Examiner*—Marion E. McCamish
*Assistant Examiner*—Steve C. Crossan
*Attorney, Agent, or Firm*—David F. Janci

[57] ABSTRACT

The invention provides coated carrier particles suitable for use in dry electrographic developers comprising a mixture of the carrier particles and toner particles. Each of the carrier particles comprises a core particle having a polymeric overcoat comprising poly(p-t-butylstyrene) or a copolymer of p-t-butylstyrene and a $C_1$–$C_4$ alkyl methacrylate, wherein the polymer further comprises sulfur-containing end groups.

5 Claims, No Drawings

COATED CARRIER PARTICLES FOR ELECTROGRAPHIC DEVELOPERS

FIELD OF THE INVENTION

This invention relates to coated carrier particles suitable for use in dry electrographic developers comprising a mix of such carrier particles and toner particles. More particularly, the invention concerns certain polymeric coatings on carrier particles that unexpectedly impart certain desirable characteristics to the carrier particles.

BACKGROUND

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer. If desired, the latent image can be transferred to another surface before development.

One well-known type of electrographic developer comprises a dry mixture of toner particles and carrier particles. Developers of this type are commonly employed in well-known electrographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the electrostatic latent image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

A number of requirements are implicit in such development schemes. Namely, the electrostatic attraction between the toner and carrier particles must be strong enough to keep the toner particles held to the surfaces of the carrier particles while the developer is being transported to and brought into contact with the latent image, but when that contact occurs, the electrostatic attraction between the toner particles and the latent image must be even stronger, so that the toner particles are thereby pulled away from the carrier particles and deposited in the desired amount on the latent image-bearing surface. In order to meet these requirements for proper development, the level of electrostatic charge on the toner and carrier particles should be maintained within an adequate range.

Toner particles in dry developers often contain material referred to as a charge agent or charge-control agent, which helps to establish and maintain toner charge within an acceptable range. Many types of charge-control agents have been used and are described in the published patent literature. However, the level of charge that will be created and maintained on the toner is still very dependent on the nature and condition of the carrier particles.

Many known dry, two-component electrostatographic developers contain thermoplastic toner particles and carrier particles that comprise a core material coated with a polymer. Such polymeric carrier coatings can serve a number of known purposes. One such purpose can be to aid the developer to meet the electrostatic force requirements mentioned above by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

Many different types of polymers have been described as useful for one or more of these purposes, among which are, for example, various styrene and methacrylate polymers and copolymers thereof. For example, U.S. Pat. Nos. 4,209,550; 4,572,885; and 4,822,708, and British published Patent Specification 1,385,231, suggest that, among many other polymers, poly(styrene), poly(methyl methacrylate), and poly(styrene-co-methyl methacrylate) may serve one or more of these purposes.

However, while such carrier coatings can serve the above-noted purposes well, in some cases they do not adequately serve some or all of those purposes simultaneously. For example, in some developer compositions, styrene and methacrylate polymer carrier coatings can serve many of the above-noted purposes well, but, depending upon the nature of the toner particles and carrier core material desired to be included in the developer, such carrier coatings can cause the developer to acquire a triboelectric charge that is too low for optimum developer performance. This is especially true in some negatively charged developers (developers in which the toner particles triboelectrically acquire a negative charge, and the coated carrier particles acquire a positive charge). The reason for this problem is that some of the suggested polymeric materials are not triboelectrically potent enough or efficient enough to achieve the desired degree of charging tendency of the carrier particles in certain developers.

Also, the less triboelectrically efficient or potent the polymer is for this purpose, the greater is the amount of the polymer that must be coated on a carrier core in order to achieve the desired level of charge, if that level can be achieved at all. However, two of the most desirable means of forming the coating on the core particles are solution-coating and melt-coating.

The procedure in melt-coating is to mix the core particles with finer particles of the coating material in solid form to distribute the coating particles over the core particles' surfaces, apply heat to cause the material to flow just enough to coat the core surfaces, allow the mix to cool, and then break apart the solidified mass to yield the discrete coated carrier particles. However, for example, in the case where carrier core particles comprise strontium ferrite materials and have average particle diameters in the range of about 30 to 40 micrometers, if the relative amount of polymeric coating material exceeds 3 parts per hundred parts (pph) of core material, the solidified mass becomes exceedingly difficult to properly break apart.

In solution-coating, the polymer is dissolved in appropriate solvent, the solution is mixed with carrier core particles, and the mixture is agitated while driving off the solvent to yield the coated carrier particles. Again, for example, in the case where carrier core particles comprise strontium ferrite materials and have average particle diameters in the range of about 30 to 40 micrometers, if the relative amount of polymeric material in the solution exceeds about 1.5–2 parts per hundred parts by weight of core particles, the particles can become agglomerated during the process, causing nonuniformities in the coating and limiting the amount of polymer that can be coated.

Thus, the amount of polymer that can be coated by such methods is limited (it should be noted that the specific maximum relative amounts of coating material, recited above for melt-coating and solution-coating the core particles specifically described, will be different for different core particles that may have different average particle sizes, different core material densities, and/or different surface area-to-mass ratios). The more efficient the polymer is at desirably altering the carrier particles' charging characteristics, the more desirable it is, in terms of achieving the desired charging characteristics and minimizing the amount of polymer that must be coated to achieve such characteristics.

Another drawback of some materials suggested as carrier-coating polymers is their lack of thermal stability, leading to degradation during coating and degradation during use in electrographic development, with consequent inconsistent triboelectric properties initially and over time and shorter carrier life (because of more carrier chipping, flaking, dusting, and scumming).

Thus, there remains a need for suitable polymers to be coated on carrier core particles to adjust their triboelectric charging characteristics with respect to various types of toner particles in electrographic developers. Such polymers should be highly triboelectrically potent or efficient in order to adequately modify carrier charging characteristics and minimize the amount of polymer in the coating, and should have good thermal stability. The present invention meets that need.

SUMMARY OF THE INVENTION

The invention provides new coated carrier particles for dry electrographic developers.

Each of the carrier particles of the invention comprises a core particle having a polymeric overcoat comprising poly(p-t-butylstyrene) or a copolymer of p-t-butylstyrene and a $C_1$–$C_4$ alkyl methacrylate, wherein the polymer further comprises sulfur-containing end groups.

The polymers defined above as useful in accordance with the invention are very efficient at modifying carrier triboelectric charging characteristics when coated thereon, and the polymers have good thermal stability.

DESCRIPTION OF PREFERRED EMBODIMENTS

The present invention is beneficially applicable to carrier particles comprising any of the core materials generally known to be useful in carrier particles for electrographic developers. The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; 4,546,060; 4,764,445; 4,855,205; and 4,855,206.

As described above, the polymer coated on the carrier core particles comprises poly(p-t-butylstyrene) or a copolymer of p-t-butylstyrene and a $C_1$–$C_4$ alkyl methacrylate (e.g., methyl methacrylate or isobutyl methacrylate). When one of the copolymers is chosen, the proportions of recurring units are not critical, but in some preferred embodiments weight proportions of 1 to 1 were employed. The polymer further comprises sulfur-containing end groups. Such polymers exhibit better thermal stability and greater efficiency in achieving desired triboelectric charging characteristics than do the polymers suggested in the prior art.

When using well-known processes of preparing the polymers, such as suspension polymerization or emulsion polymerization, it is a simple matter to create sulfur-containing end groups in a known manner, for example, by using a persulfate as the polymerization initiator and/or by including a mercaptan chain transfer agent in the polymerization process. When a mercaptan chain transfer agent is employed, it is preferable to include a relatively small amount of such agent (e.g., about 1 percent or less, based on the total weight of monomers employed) so as not to create an inordinate amount of chain termination that would yield polymers of such low molecular weight that they would be too brittle to serve well as carrier coating materials.

As mentioned previously, the polymers useful in the present invention have better thermal stability than polymers taught in the prior art to be coated on carriers. This can be illustrated by comparing the results of thermal gravimetric analysis tests on the various polymers, wherein the polymer is heated in air, the temperature of which is slowly increased from 75° to 800° C., and the temperature at which noticeable weight loss first occurs is noted. For example, the temperature at which initial noticeable weight loss occurs is 283° C. for poly(methyl methacrylate) and 281° C. for poly(styrene-co-methyl methacrylate) (50:50 by weight) (both polymers not useful within the scope of the invention), while the onset of weight loss occurs at 306° C. for a poly(p-t-butylstyrene-co-methyl methacrylate) (50:50 by weight) having sulfur-containing end groups (a polymer useful within the scope of the invention). Also, when maintained at 230° C. for 4 hours, the polymer noted above as useful in the invention suffered only 2.6% weight loss due to degradation, while the two noted polymers not useful in the invention suffered 11.5% and 12.7% weight loss, respectively.

Methods of coating a polymer onto carrier core particles in a continuous or discontinuous configuration of various uniform or non-uniform thickness are well known. Some useful coating methods include solution-coating, spray application, plating, tumbling, shaking, fluidized bed coating, and melt-coating. Any such methods can be employed to prepare the coated carrier particles of this invention. See, for example, U.S. Pat. Nos. 4,546,060; 4,478,925; 4,233,387; 4,209,550; and 3,507,686.

In coating polymers useful for the present invention, relative amounts of the polymer can be varied to achieve the desired properties. Optimum amounts will depend on the nature of all materials involved (including the nature of toner particles with which the carrier particles are intended to be subsequently mixed in order to form a developer) and the amount of charge per unit mass desired, but, for example, in the specific case of strontium ferrite core particles having average particle diameters in the range of about 30 to 40 micrometers, the coating will usually comprise, by weight, 3 pph coating material (parts per hundred parts core material) or less, if melt-coating is employed (because higher proportions of coating material may make it very difficult to properly break apart the solidified mass to yield the discrete coated carrier particles) and about 2 pph coating material or less, if solution-coating is employed (because higher proportions of coating material can cause particle agglomeration while driving off the solvent, with consequent incompleteness and/or non-uniformity of the coating). Note again that these preferable upper limits of weight ratios of coating material to core material will vary as surface area-to-mass ratio of the core particles varies; i.e., the preferable upper limits will be higher when surface area-to-mass is higher than in the specific case noted and will be lower when surface area-to-mass is lower than in the specific case noted.

The resultant carrier particles can be spherical or irregular in shape, can have smooth or rough surfaces, and can be of any size known to be useful in developers. Conventional carrier particles usually have an average particle diameter in the range of about 2 to about 1200 micrometers, preferably 2–300 micrometers.

In some preferred embodiments of the invention strontium ferrite core particles having an average diameter of about 30 micrometers (μm) were mixed with 1 pph poly(p-t-butylstyrene), poly(p-t-butylstyrene-co-methyl methacrylate)(50:50 recurring unit weight ratio), or poly(p-t-butylstyrene-co-isobutyl methacrylate)(50:50 weight ratio), all with sulfur-containing end groups, and all dissolved in an appropriate coating solvent, such as dichloromethane. The mix was agitated while maintaining the solution at about 120° C. for 2 hours to drive off the solvent and fix the coating on the core particles, and then allowed to cool to room temperature, to yield the discrete coated carrier particles.

In forming electrographic developers, the inventive carrier particles can be mixed with any suitable toner particles known to be useful in dry electrographic developers. Carriers of the present invention are especially advantageous in developers wherein the toner particles triboelectrically acquire a negative charge during mixing, while the carrier particles acquire a positive charge.

Useful toner particles comprise at least a binder resin and, optionally, other addenda such as colorants, charge-control agents, release agents, etc., as is well known.

Many resins have been reported in the published literature as being useful as dry toner binders. These include vinyl polymers, such as homopolymers and copolymers of styrene and condensation polymers such as polyesters and copolyesters. Especially useful binder resins are styrenic polymers of from 40 to 100 percent by weight of styrene or styrene homologs and from 0 to 45 percent by weight of one or more lower alkyl acrylates or methacrylates. Preferred are fusible styrene-acrylic copolymers which are covalently lightly cross-linked with a divinyl compound such as divinylbenzene as disclosed in the patent to Jadwin et al, U.S. Pat. No. Re. 31,072. Also especially useful are polyesters of aromatic dicarboxylic acids with one or more aliphatic diols, such as polyesters of isophthalic or terephthalic acid with diols such as ethylene glycol, cyclohexane dimethanol and biphenols. Examples are disclosed in the patent to Jadwin et al, above.

Useful binder resins have fusing temperatures in the range of about 50° C. to 200° C. so that the toner particles can readily be fused after development. Preferred are resins which fuse in the range of about 65° C. to 120° C. If toner transfer is made to receiving sheets which can withstand higher temperatures, polymers of higher fusing temperatures can be used.

A colorant for the toner can be selected from a wide variety of dyes and pigments such as those disclosed, for example, in U.S. Pat. No. Re. 31,072. A particularly useful colorant for toners to be used in black and white electrophotographic copying machines is carbon black. The amount of colorant in the toner can vary over a wide range, for instance, from 1 to 20 weight percent of the toner. For some uses, no colorant is added to the toner, but usually from about 1 to 6 weight percent of colorant is present.

Other addenda can include charge control agents, those usually being ionic compounds such as certain metal-azo complexes and metal salts and complexes of certain benzoic and naphthoic acids. Suitable charge control agents are disclosed, for example, in U.S. Pat. Nos. 4,656,112; 4,206,064; 4,824,751 and 4,433,040. Only a small concentration of charge control agent is normally used in the toner composition, e.g., from about 0.05 to 6 weight percent and preferably from 0.05 to 2.0 weight percent.

Useful toner particles range in diameter from 0.5 to 25 micrometers with an average size of 1 to 16 micrometers. Preferably, the average particle size ratio of carrier to toner is within the range of about 15:1 to about 1:1. However, carrier-to-toner average particle size ratios of as high as 50:1 are also useful.

In developers containing carriers of the invention, high concentrations of toner can be employed. Accordingly, the developer can contain from about 70 to 99 weight percent carrier and from about 30 to 1 weight percent toner based on the total weight of the developer; most preferably, such concentration is from about 80 to 99 weight percent carrier and from about 20 to 1 weight percent toner.

Developer compositions containing carriers of this invention can be used in various known ways to develop electrostatic charge patterns or latent images. Such developable charge patterns can be prepared by a number of means and be carried, for example, on a light-sensitive photoconductive element or a non-light-sensitive dielectric-surfaced element such as an insulator-coated conductive sheet. One suitable development technique involves cascading the developer composition across the electrostatic charge pattern, while another technique involves applying toner particles from a developer formed into a magnetic brush by a magnetic applicator apparatus. This latter technique involves the use of magnetically attractable carrier particles in forming the developer composition. After imagewise deposition of the toner particles, the image can be fixed, e.g., by heating the toner to cause it to fuse to the substrate carrying the toner. If desired, the unfused image can be transferred to a receiver such as a blank sheet of paper and then fused to form a permanent image.

The following examples are presented to further illustrate some preferred embodiments of carriers of the invention and to compare their properties in developers to those of carriers outside the scope of the invention.

In all of the following examples and controls the carrier particles comprised strontium ferrite carrier cores solution-coated with various polymers. They were prepared by using a formulation comprising 1 part by weight of various polymers, and 100 parts by weight strontium ferrite particles. The polymer was dissolved in dichloromethane, and the solution was mixed with the ferrite particles. The mixture was agitated while being maintained at about 120° C. for 2 hours to drive off the solvent and then allowed to cool to room temperature to yield the coated carrier particles.

In the Examples the triboelectric properties of the carrier particles were indirectly determined by measuring the degree of charge imparted to toner particles with which they were mixed. The degree of charge was determined by mixing the carrier particles with typical toner particles (comprising a cyan colorant dispersed in a poly(ester-amide) binder) to form a charged electrographic developer comprising 10% toner particles by weight and measuring the level of charge residing on the toner particles, in microcoulombs per gram of toner (μc/g), after 5 minutes of continuous exercise of the developer. The continuous exercise of the developer involved placing the magnetized developer in a glass bottle held in place on top of a typical device designed to form a developer into an agitating magnetic brush for development of electrostatic images into toner images (in this case a cylindrical roll with rotating magnetic core). Thus, the continuous exercising closely approximated typical actual use of the developer in an electrographic development process.

Since the purpose in measuring toner charge level in the examples was merely to illustrate the degree of charge of developers containing inventive carrier particles relative to the degree of charge of similar developers containing carriers not in accordance with the invention, any known convenient method for measuring toner charge levels could be used. In the examples below, toner charge level was measured by placing a 0.05 to 0.1 g portion of the charged developer in a sample dish situated between electrode plates and subjecting it, simultaneously for 30 seconds, to a 60 Hz magnetic field to cause developer agitation and to an electric field of about 2000 volts/cm between the plates. The toner is released from the carrier and is attracted to and collects on the plate having polarity opposite to the toner charge. The total toner charge is measured by an electrometer connected to the plate, and that value is divided by the weight of the toner on the plate to yield the charge per mass of toner in microcoulombs per gram (μc/g).

In the examples and controls, whenever a copolymer formed from two different monomers was employed, the weight ratio of the two different types of recurring units was 50:50. Where the notation, "1% TDDM", appears after the name of a polymer, this is intended to mean that the polymer includes sulfur-containing end groups formed by preparing the polymer by polymerization in the presence of 1 part by weight of the chain transfer agent, t-dodecylmercaptan, per 100 parts by weight of the total monomers present during the polymerization. As noted previously, all coatings in the examples and controls contained 1 part by weight of polymer coating per 100 parts by weight of carrier core material.

EXAMPLES 1-3

In examples 1-3, the effect on toner charge of including various polymers in carrier coatings in accordance with the invention, is illustrated and compared to control examples containing various polymers, not in accordance with the invention, in the carrier coatings. Results are presented in Table I.

TABLE I

| Example | Coated Polymer | Toner Charge (μc/g) |
|---|---|---|
| Control A | polystyrene | −38.8 |
| Control B | poly(methyl methacrylate) | −39.2 |
| Control C | poly(styrene-co-methyl methacrylate) | −52.0 |
| 1 | poly(p-t-butylstyrene)(1% TDDM) | −63.2 |
| 2 | poly(p-t-butylstyrene-co-methyl methacrylate)(1% TDDM) | −70.5 |
| 3 | poly(p-t-butylstyrene-co-iso-butyl methacrylate(1% TDDM) | −73.6 |

The data in Table I illustrate that coated carriers in accordance with the invention caused toners to acquire a significantly higher triboelectric charge than did coated carriers outside the scope of the invention; i.e., the polymeric coatings of carriers of the invention were more efficient at imparting desired charging characteristics.

The invention has been described in detail, with particular reference to certain preferred embodiments thereof, but it should be understood that variations and modifications can be effected within the spirit and scope of the invention.

What is claimed is:

1. Carrier particles suitable for use in a dry electrographic developer comprising a mix of the carrier particles and toner particles, wherein each of the carrier particles comprises a core particle having an overcoat of a polymer, comprising poly(p-t-butylstyrene) or a copolymer of p-t-butylstyrene and a $C_1$–$C_4$ alkyl methacrylate, and wherein the polymer further comprises sulfur-containing end groups.

2. The carrier particles of claim 1, wherein the polymer comprises poly(p-t-butylstyrene), poly(p-t-butylstyrene-co-methyl methacrylate), or poly(p-t-butylstyrene-co-isobutyl methacrylate).

3. The carrier particles of claim 1, wherein the core particle comprises a metallic material.

4. The carrier particles of claim 3, wherein the metallic material is ferromagnetic.

5. The carrier particles of claim 3, wherein the metallic material comprises a strontium ferrite material.

* * * * *